US009438989B2

(12) United States Patent
Chu et al.

(10) Patent No.: US 9,438,989 B2
(45) Date of Patent: Sep. 6, 2016

(54) HEADPHONE STRUCTURE FOR ADJUSTING AUDIO FREQUENCIES

(71) Applicant: Huiyang Dongmei Audio Products Co., Ltd., Huizhou, Guangdong (CN)

(72) Inventors: Ming-Chung Chu, New Taipei (TW); Ping-Tang Lee, New Taipei (TW)

(73) Assignee: Huiyang Dongmei Audio Products Co., Ltd., Huizhou (CN)

( * ) Notice: Subject to any disclaimer, the term of this patent is extended or adjusted under 35 U.S.C. 154(b) by 0 days.

(21) Appl. No.: 14/529,179

(22) Filed: Oct. 31, 2014

(65) Prior Publication Data

US 2015/0382099 A1 Dec. 31, 2015

(30) Foreign Application Priority Data

Jun. 27, 2014 (CN) ..... 2014 2 0351661 u

(51) Int. Cl.

| | |
|---|---|
| ***H04R 1/28*** | (2006.01) |
| *H04R 25/00* | (2006.01) |
| *H04R 1/22* | (2006.01) |
| *H04R 1/10* | (2006.01) |

(52) U.S. Cl.

CPC ..... *H04R 1/2811* (2013.01); *H04R 1/10* (2013.01); *H04R 1/1016* (2013.01); *H04R 1/1058* (2013.01); *H04R 1/22* (2013.01); *H04R 25/48* (2013.01); *H04R 25/652* (2013.01)

(58) Field of Classification Search

CPC H04R 1/1091; H04R 1/28; H04R 2205/024; H04R 2201/103; H04R 2205/022; H04R 2420/07; H04R 1/10; H04R 1/1008; H04R 1/1016; H04R 1/105; H04R 1/058; H04R 1/1066; H04R 1/1075; H04R 5/033; H04R 5/027; H04R 5/0335; H04R 1/2811; H04R 1/1058; H04R 1/22; H04R 25/652; H04R 25/48

USPC ..... 381/358, 367, 370, 371, 374, 375, 380

See application file for complete search history.

(56) References Cited

U.S. PATENT DOCUMENTS

| | | | | |
|---|---|---|---|---|
| 3,999,020 | A * | 12/1976 | Bastiaans | H04R 1/1041 381/354 |
| 5,729,605 | A * | 3/1998 | Bobisuthi | H04R 1/225 379/430 |
| 8,837,765 | B2 * | 9/2014 | Lin | H04R 1/2807 381/371 |
| 9,113,259 | B2 * | 8/2015 | Pan | H04R 1/2811 |
| 2011/0058704 | A1 * | 3/2011 | Harlow | H04R 1/1016 381/380 |
| 2012/0114160 | A1 * | 5/2012 | Lin | H04R 1/1091 381/380 |
| 2012/0243726 | A1 * | 9/2012 | Hosoo | H04R 1/1016 381/380 |
| 2015/0016653 | A1 * | 1/2015 | Lu | H04R 1/2826 381/379 |

* cited by examiner

*Primary Examiner* — Davetta W Goins
*Assistant Examiner* — Oyesola C Ojo

(57) ABSTRACT

A headphone structure for adjusting audio frequencies is provided, which comprises a front housing, a rear housing, a sound-producing unit in the front housing and an elastic ear-contacting body sleeving the front housing. The front housing has at least one slot or recess, and the elastic ear-contacting body sleeves the front housing to form at least one gap. The headphone structure for adjusting audio frequencies of the present invention has better results for the adjustment of bass frequencies. In addition, the headphone structure of the present invention is not complicated and is easy to manufacture. The headphone structure of the present invention can be applied to various types of headphone, such as in-ear headphones and circumaural headphones.

2 Claims, 9 Drawing Sheets

HEADPHONE STRUCTURE FOR ADJUSTING AUDIO FREQUENCIES

CROSS-REFERENCE TO PRIOR APPLICATION

This application claims the benefit of Chinese utility model patent application No. 201420351661.4, filed on Jun. 27, 2014, which is incorporated herein by reference.

FIELD OF THE INVENTION

The present invention relates to a headphone structure, and more particularly, to a new headphone structure for adjusting bass frequencies.

BACKGROUND OF THE INVENTION

A headphone is a pair of small loudspeakers that are designed to be held in place close to a user's ears. However, the soundstage given by existing headphones is usually not very spacious or not realistic. In order to let the user experience a more natural sound, many methods for adjusting audio frequencies have been applied to the existing headphones. In one of the methods, a small piece of sponge is used for producing a certain distance between a sound-producing unit and the ear, such that the ear not only hears sounds emitted from its adjacent sound-producing unit but also hears sounds emitted from its opposite sound-producing unit. In another method, the sound-producing unit is designed to be close to the ear and is arranged forward. In another method, sounds are reproduced through circuitries. The above-mentioned methods, however, are complicated and have down side.

SUMMARY OF THE INVENTION

In order to solve the above technical problems, the present invention provides a headphone structure for adjusting bass frequencies in a better way. The headphone structure of the present invention is not complicated and is easy to manufacture.

The technical solution provided by the present invention is a new headphone structure for adjusting bass frequencies comprising a front housing, a rear housing, a sound-producing unit in the front housing and an elastic ear-contacting body sleeving the front housing, wherein the front housing is provided with at least one slot or recess, and the elastic ear-contacting body sleeves the front housing to form at least one gap.

In an embodiment of the present invention, the headphone is an in-ear headphone, the elastic ear-contacting body is an elastic plug, and the in-ear headphone further comprises a mesh cap for covering the front housing of the headphone.

In another embodiment of the present invention, the elastic plug is provided with a base ring, the front housing is provided with a step for engaging with the base ring, and a contacting surface of the base ring and the step is a concave-convex surface.

In another embodiment of the present invention, the headphone is a circumaural headphone, and the elastic ear-contacting body is an elastic earpad.

As compared with prior arts, the headphone structure for adjusting audio frequencies of the present invention has better results for the adjustment of bass frequencies. In addition, the headphone structure of the present invention is not complicated and is easy to manufacture. The headphone structure of the present invention can be applied to various types of headphone, such as in-ear headphones and circumaural headphones.

DETAILED DESCRIPTION OF ILLUSTRATED EMBODIMENTS

Detailed embodiments of the present invention are described below in conjunction with drawings and examples:

Embodiment 1

Figure 1:
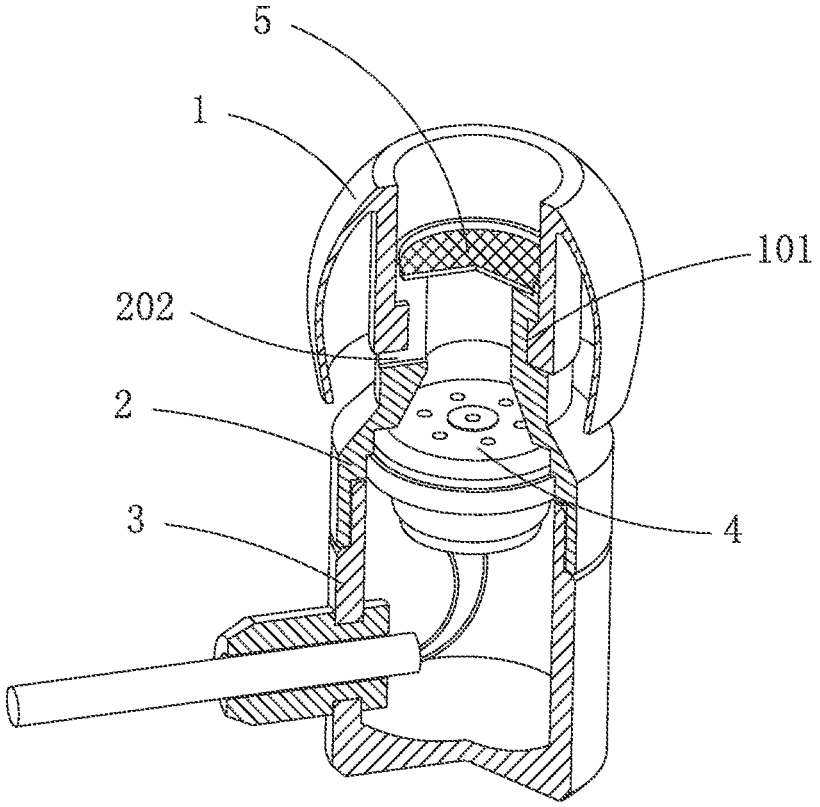
FIG. 1 is a three-dimensional cross-sectional view of an in-ear headphone according to a first embodiment of the present invention.
Figure 6:
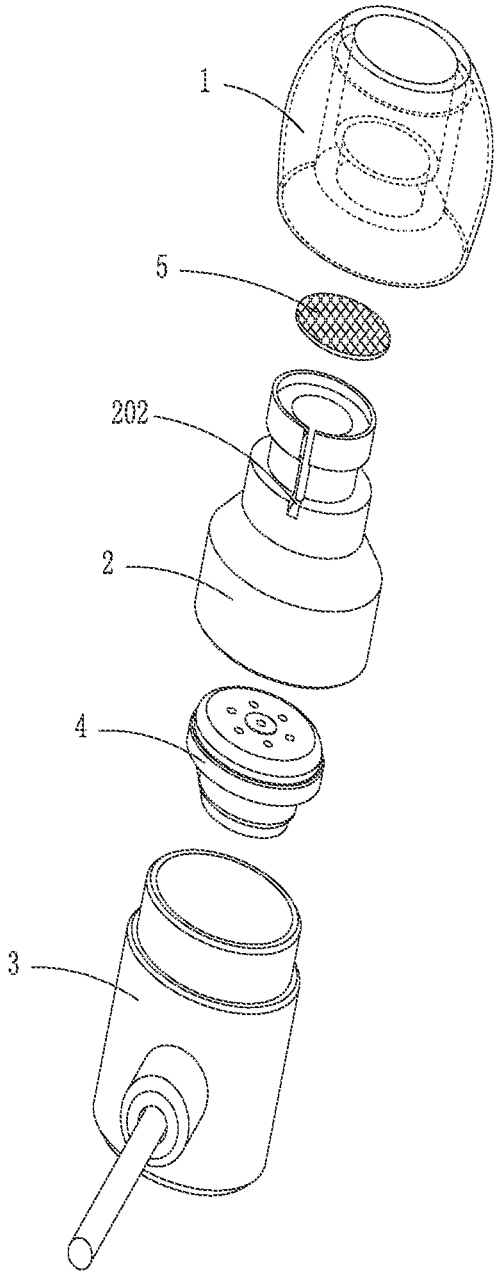
FIG. 6 is an exploded view of the in-ear headphone according to the first embodiment of the present invention.
Figure 8:
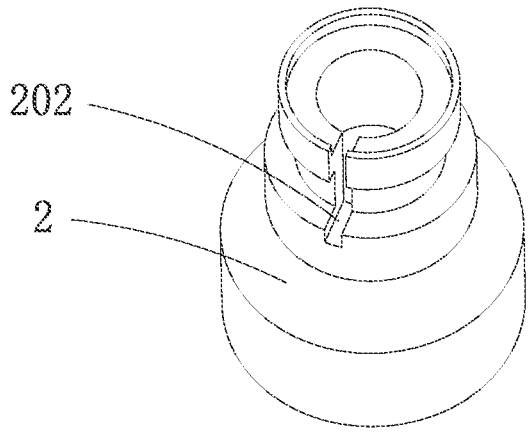
FIG. 8 is a schematic view of a front housing of the in-ear headphone in FIG. 1 according to the first embodiment of the present invention.

As shown in FIGS. 1, 6 and 8, the present invention relates to a headphone structure for adjusting audio frequencies, in this embodiment, the headphone is an in-ear headphone, comprising a front housing 2, a rear housing 3, a sound-producing unit 4 arranged in the front housing 2 and an elastic plug 1 sleeving the front housing 2, wherein the front housing 2 is provided with at least one slot. In this embodiment, the front housing 2 is provided with a slot 202, a mesh cap 5 is arranged on the front housing 2, and the elastic plug 1 may sleeve the front housing 2. The elastic plug 1 has a base ring 101, after the front housing 2 has been sleeved with the elastic plug 1, a gap is formed between the front housing 2 and the elastic plug 1. The size of the gap defines the adjustable range of the bass frequencies, in this way, a control of bass sounds is achieved.

Embodiment 2

Figure 2:
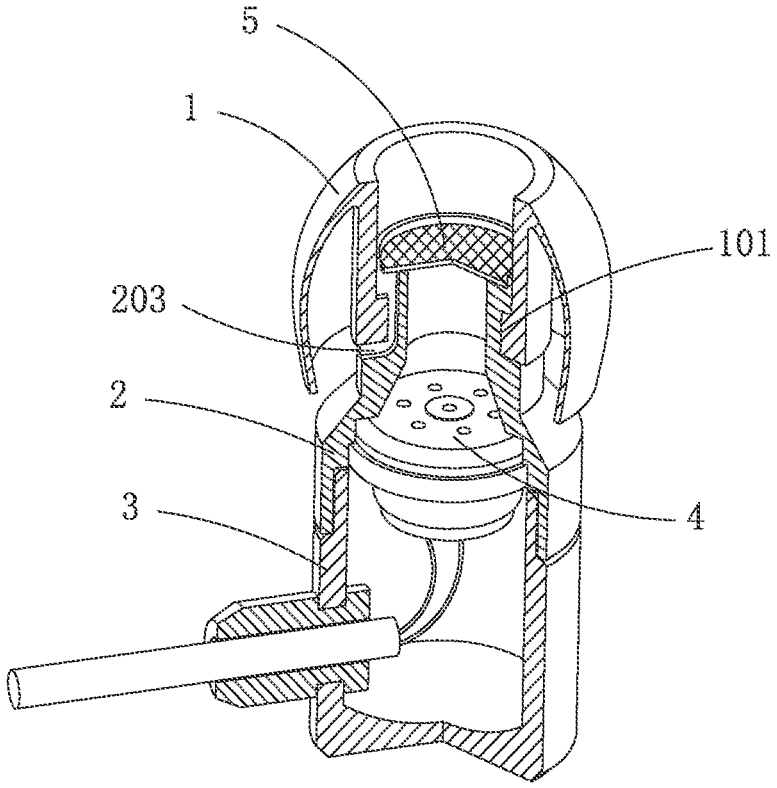
FIG. 2 is a three-dimensional cross-sectional view of an in-ear headphone according to a second embodiment of the present invention.
Figure 9:
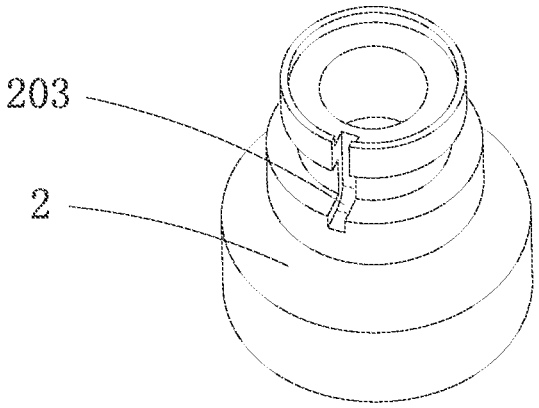
FIG. 9 is a schematic view of a front housing of the in-ear headphone in FIG. 2 according to the second embodiment of the present invention.

Referring to FIGS. 2 and 9, the headphone structure of the Embodiment 2 differs from that of Embodiment 1 in that, an outer wall of the front housing 2 is provided with at least one recess, for example, the outer wall of the front housing 2 is provided with a recess 203. A mesh cap 5 is arranged on the front housing 2. When the outer wall of the front housing 2 is sleeved with an inner wall of an elastic plug 1, a gap is formed between the inner wall of the elastic plug 1 and the outer wall of the front housing 2. The size of the gap defines the adjustable range of the bass frequencies, in this way, a control of bass sounds is achieved. Optionally, more than one gap can be provided.

Embodiment 3

Figure 3:
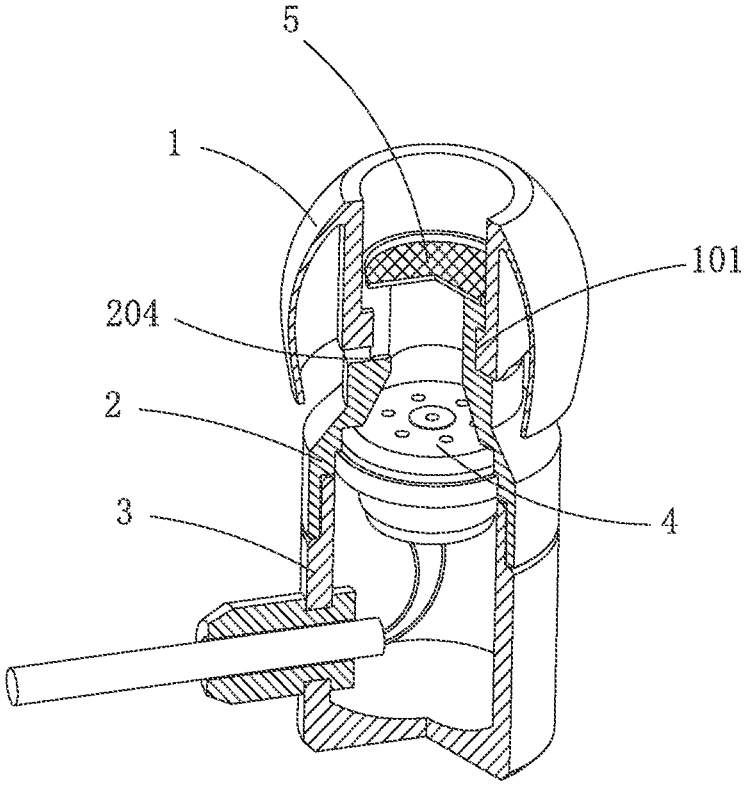
FIG. 3 is a three-dimensional cross-sectional view of an in-ear headphone according to a third embodiment of the present invention.
Figure 10:
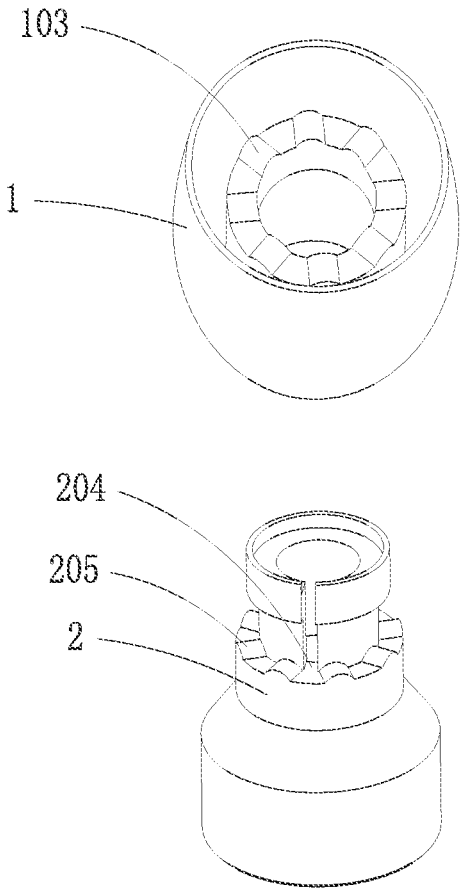
FIG. 10 is an exploded view of the in-ear headphone in FIG. 3 according to the third embodiment of the present invention.

Referring to FIGS. 3 and 10, the headphone structure of the Embodiment 3 differs from that of Embodiment 1 in that, the base ring 101 is provided with a concave-convex structure 103 at the bottom thereof, the front housing 2 is provided with a concave-convex step 205 for engaging with and abutting against the concave-convex structure 103 of the base ring 101. A contacting surface of the base ring 101 and the step 205 is a concave-convex surface. For example, a convex portion of the concave-convex structure 103 may fit into a concave portion of the concave-convex step 205. By adjusting a fluctuation degree of a concave-convex portion 204 of the concave-convex step 205, the size of the gap can be adjusted.

In an embodiment of the present invention, the base ring of the elastic plug 1 of the headphone structure of the Embodiment 2 is also provided with a concave-convex structure, and the front housing 2 of the Embodiment 2 is also provided with a concave-convex step for engaging with and abutting against the concave-convex structure.

Embodiment 4

Figure 4:
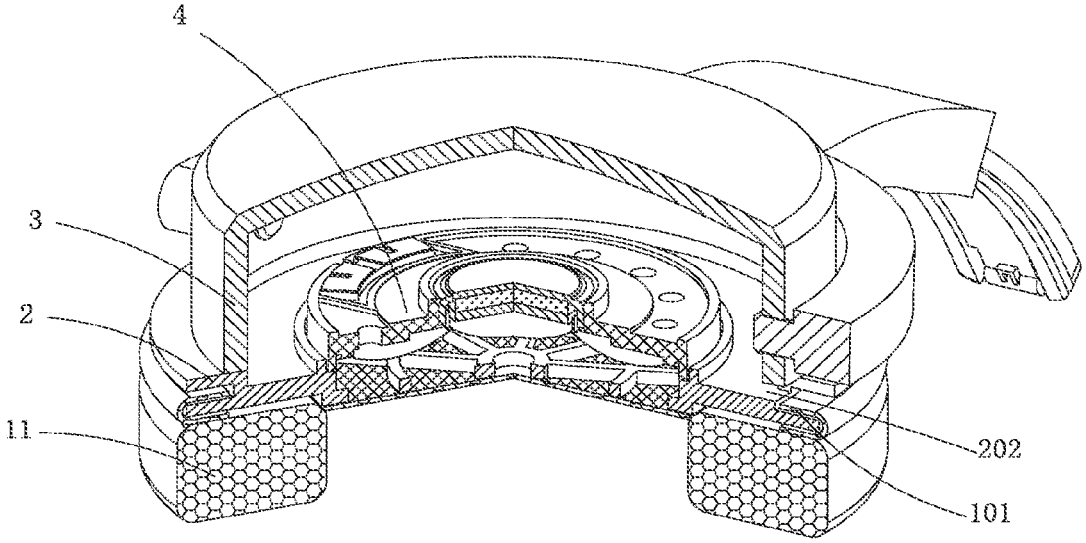
FIG. 4 is a three-dimensional cross-sectional view of a circumaural headphone according to a fourth embodiment of the present invention.
Figure 7:
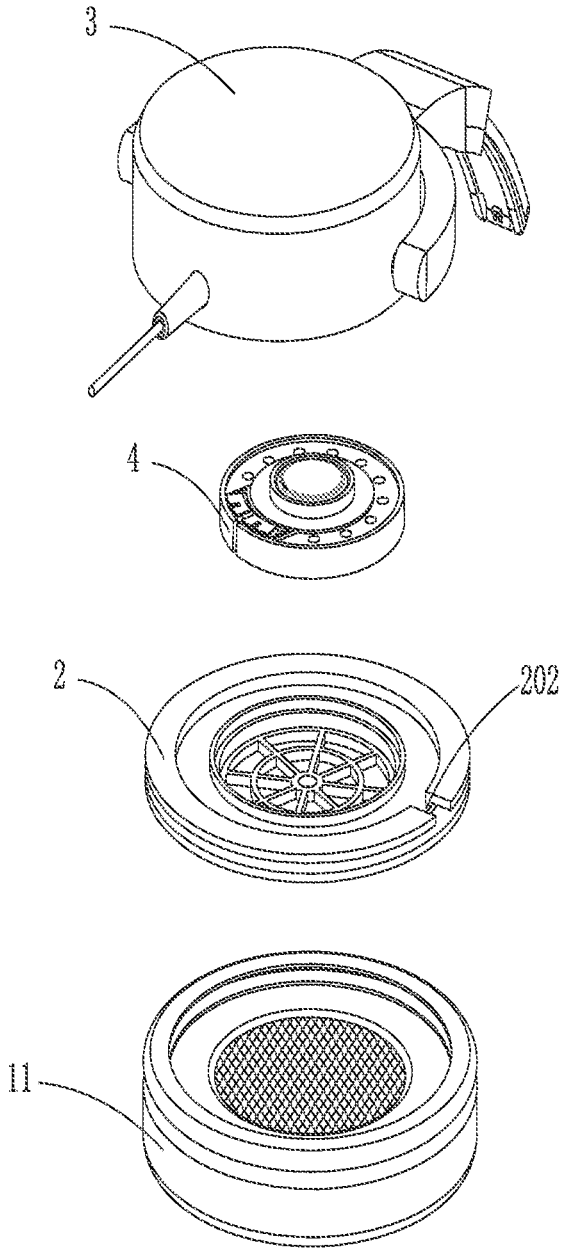
FIG. 7 is an exploded view of the circumaural headphone according to the fourth embodiment of the present invention.
Figure 11:
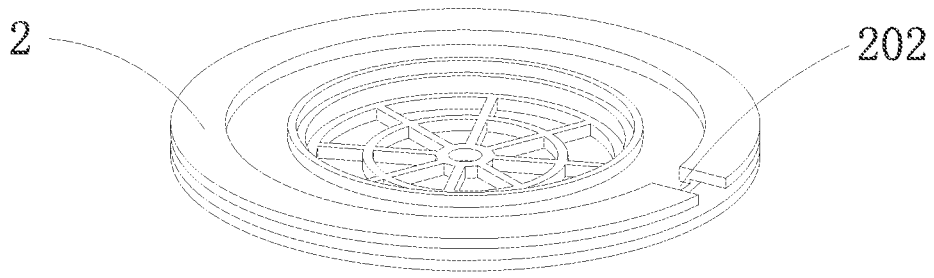
FIG. 11 is a schematic view of a front housing of the circumaural headphone according to the fourth embodiment of the present invention.

As shown in FIGS. 4, 7 and 11, the present invention relates to a headphone structure for adjusting audio frequencies, in this embodiment, the headphone is a circumaural headphone, comprising a front housing 2, a rear housing 3, a sound-producing unit 4 arranged on the front housing 2 and an elastic earpad 11 sleeving the front housing 2, wherein the front housing 2 is provided with at least one slot. In this embodiment, the front housing 2 is provided with a slot 202. After the front housing 2 has been sleeved with the elastic earpad 11, a gap is formed between the front housing 2 and the elastic earpad 11. The size of the gap defines the adjustable range of the bass frequencies, in this way, a control of bass sounds is achieved. Optionally, more than one gap can be provided.

Embodiment 5

Figure 5:
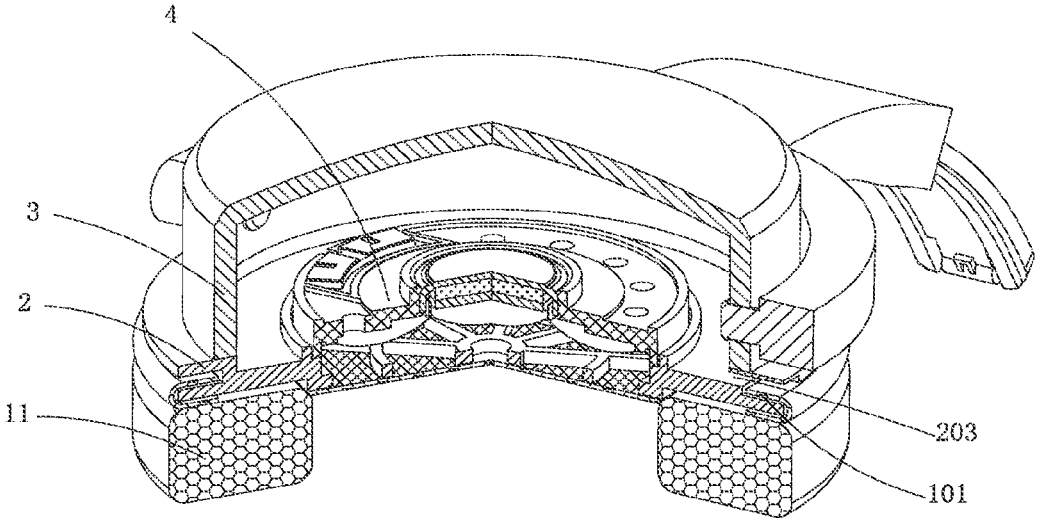
FIG. 5 is a three-dimensional cross-sectional view of a circumaural headphone according to a fifth embodiment of the present invention.
Figure 12:
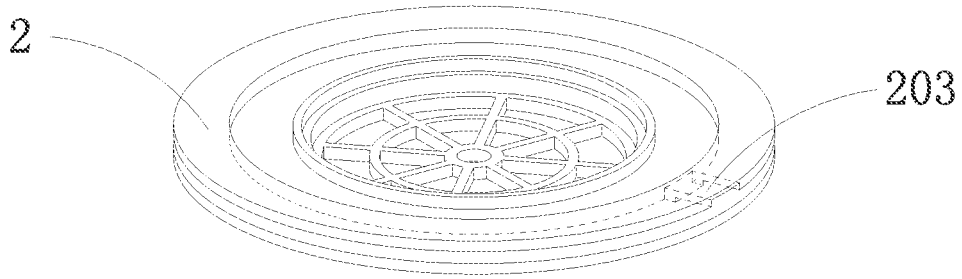
FIG. 12 is a schematic view of a front housing of the circumaural headphone according to the fifth embodiment of the present invention.

Referring to FIGS. 5 and 12, the headphone structure of the Embodiment 5 differs from that of Embodiment 4 in that, an outer wall of the front housing 2 is provided with at least one recess, for example, the outer wall of the front housing 2 is provided with a recess 203. After the front housing 2 has been sleeved with the elastic earpad 11, a gap is formed between the front housing 2 and the elastic earpad 11. Optionally, more than one gap can be provided.

Many other changes and modifications can be made without departing from the conception and range of the present invention. It should be understood that, the present invention is not limited to any particular embodiment, and the range of the present invention is defined in the annexed claims.

LIST OF REFERENCE NUMERALS OF MAIN COMPONENTS

1 elastic plug
101 base ring
103 concave-convex structure
11 elastic earpad
2 front housing
202 slot
203 recess
204 concave-convex portion
205 concave-convex step
3 rear housing
4 sound-producing unit
5 mesh cap

What is claimed is:

1. A headphone structure for adjusting audio frequencies, comprising a front housing, a rear housing, a sound-producing unit in the front housing and an elastic ear-contacting body sleeving the front housing, the headphone is an in-ear headphone, the elastic ear-contacting body is an elastic plug, characterized in that the front housing is provided with at least one slot or recess, and the elastic plug sleeves the front housing to form at least one gap;

the elastic plug is provided with a base ring, the base ring is provided with a concave-convex structure at the bottom thereof, the front housing is provided with a concave-convex step for engaging with and abutting against the concave-convex structure of the base ring, the concave-convex step is provided with a concave-convex step, by adjusting a fluctuation degree of the concave-convex portion of the concave-convex step, the size of the gap can be adjusted.

2. The headphone structure for adjusting audio frequencies as claimed in claim 1, characterized in that the in-ear headphone further comprises a mesh cap for covering the front housing of the headphone.

* * * * *